United States Patent [19]

Ando et al.

[11] 4,351,266

[45] Sep. 28, 1982

[54] APPARATUS FOR DIPPING PLATING

[75] Inventors: Masato Ando, Yokohama; Kenji Yamamoto, Komae; Kazuhiro Taniguchi, Hiratsuka, all of Japan

[73] Assignee: Electroplating Engineers of Japan, Limited, Tokyo, Japan

[21] Appl. No.: 141,094

[22] Filed: Apr. 17, 1980

[30] Foreign Application Priority Data

Dec. 29, 1979 [JP] Japan ..... 54-172183

[51] Int. Cl.[3] ..... B05C 3/02; B65G 49/04

[52] U.S. Cl. ..... 118/425; 118/428; 134/82; 134/83; 134/165; 204/198; 204/297 W

[58] Field of Search ..... 118/425, 428, 503; 204/297 R, 297 W, 198; 228/40; 134/82, 83, 164, 165

[56] References Cited

U.S. PATENT DOCUMENTS 3,056,371 10/1962 Frank ..... 228/40

3,828,419 9/1972 Wanner ..... 118/425

*Primary Examiner*—Ralph S. Kendall

*Attorney, Agent, or Firm*—Blanchard, Flynn, Thiel, Boutell & Tanis

[57] ABSTRACT

An apparatus for dipping plating objects such as IC lead frame of a rectangular shape obtained by press forming and etching thin metal pieces, wherein a plural number of said rectangular sheets aligned and supported on the freely descending and returning rack base of the support carriage of the objects to be plated are concurrently subjected to dipping plating by determining the position of the said plural number of rectangular sheets to be plated for lowering into the plating tanks, and abutting the upper surface of the objects to be plated with the holding means thereby subjecting a plural number of objects to be plated.

19 Claims, 20 Drawing Figures

APPARATUS FOR DIPPING PLATING

BACKGROUND OF THE INVENTION

The present invention concerns an apparatus for dipping plating, and more particularly it concerns an apparatus for subjecting a plurality of rectangular objects to dipping plating.

Although there are numerous devices for dipping plating proposed and practiced in the conventional art, an apparatus for dipping plating such objects as an IC lead frame, which comprises a thin metal piece of a rectangular shape which has been subjected to press working and etching to obtain a predetermined, comparatively small size, is not available in the art as far as the inventors of this invention are aware. One reason for this is that it is difficult to process a number of such rectangular objects simultaneously. Also, it is difficult to improve the processing efficiency of such an apparatus, even if it were available, compared to the efficiency of other apparatuses used for other methods of processing, for instance the process of plating a long piece of coiled material by rewinding such a coil and plating the same while it is being transferred, and cutting the thus-plated objects into predetermined sizes and shapes.

When objects like an IC lead frame, comprising rectangular thin metal pieces which have been previously subjected to press forming and etching are to be dipping plated, a number of the objects to be plated are aligned on the support carriages, and the carriages are transported over a line to be subjected to various desirable processes in the plating baths in which various types of plating steps, such as washing with water, degreasing, strike plating, plating, washing with hot water, drying, etc., are carried out.

It has been considered quite difficult to develop an apparatus for dipping plating which is efficient and which can comply with the demand as mentioned above.

SUMMARY OF THE INVENTION

The present invention concerns an apparatus for dipping plating which has been developed with an intent to satisfy the above mentioned demand, and it aims at offering an apparatus which can efficiently lower into tanks a number of objects to be plated which are aligned and supported on the carriages in the same position and also abut the upper surface of the objects to be plated with a holding means.

Another object of the present invention is to offer a multi-purpose apparatus which may be used in various plating steps suitable for the dipping plating process. Accordingly, the term "dipping plating process" used heretofore and hereinafter has a wide scope of meaning, and the present invention aims at offering an apparatus which may be used not only for the plating process proper but also for the pre-plating and post-plating steps such as degreasing, washing with water, washing with hot water, neutralizing, washing with water, electrolytic degreasing, washing with water, strike plating, plating, washing with water, washing with hot water, washing with hot pure water and drying.

The aforementioned and other purposes and features of the present invention will be understood in further detail when viewed in the light of the following description and the attached drawings wherein FIGS. 1 to 20 illustrate embodiments of the present invention.

DETAILED DESCRIPTION OF THE PREFERRED EMBODIMENTS

Figure 1:
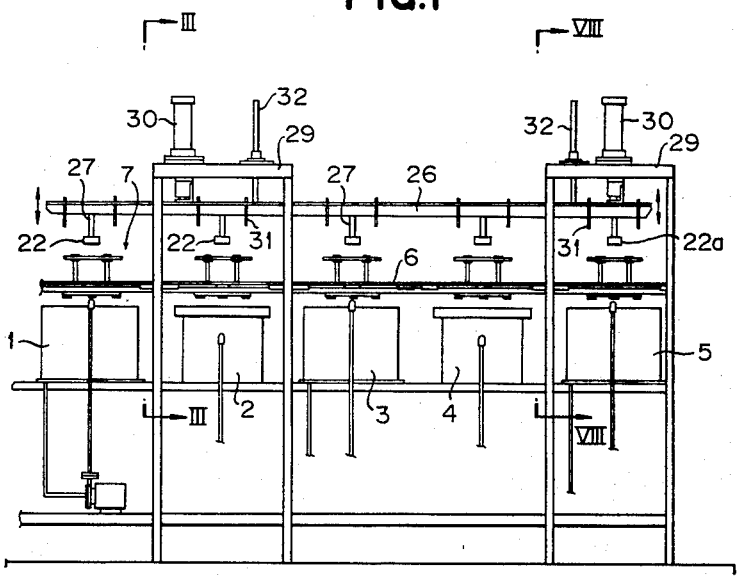
FIG. 1 is a schematic front view of the plating line.

The details of the present invention will now be explained with reference to the attached drawings.

FIGS. 1 to 7 show one embodiment of the apparatus for a dipping plating process. In the description of the construction of the apparatus, it should be noted that there are provided the dipping plating tanks 1, 2, 3, 4, and 5 corresponding to the processing steps of the plating line. The plating tank 1 is for electrolytic degreasing, the tank 2 is for washing with water, tank 3 for activation process, tank 4 is for washing with water, and tank 5 is for overall strike plating, respectively.

Figure 2:
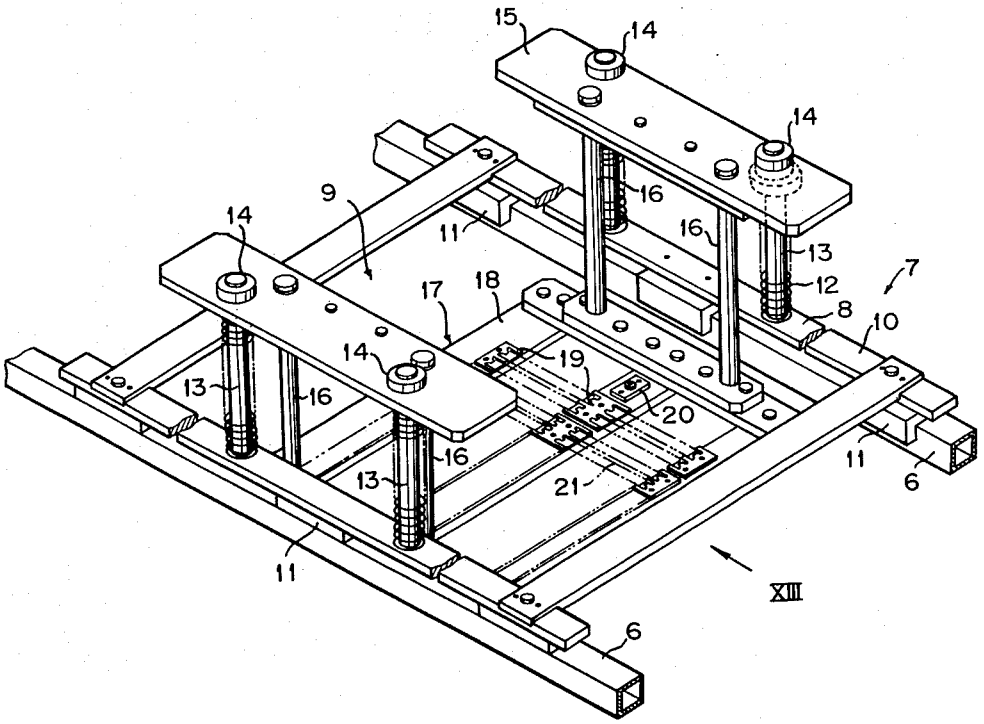
FIG. 2 is a perspective view of a carriage for carrying objects to be plated.

A pair of rails 6 extends above the dipping plating tanks 1, 2, 3, 4, and 5 on top of which are placed movable carriages 7 for carrying objects to be plated in such a way that one carriage is positioned above each of the dipping plating tanks 1, 2, 3, 4, and 5, respectively. FIG. 2 shows the type of the carriage 7 employed in this invention and a detailed description thereof is made hereinbelow. The support carriage 7 comprises a combination of a carrier 8 and a rack 9, said carrier 8 having a plurality of sliders 11 which become engaged with said rail 6 below a carrier base 10 shaped like a frame and four standing bars 13 each provided with a spring 12 on the upper surface of carrier base 10. There is attached a mobile bush 14 at the upper end of the respective standing bar 13 abutting against the upper end of the spring 12. The rack 9 comprises two bush plates 15, a rack base 17 shaped like a frame suspended from the carrier 8 via four suspension bars 16, and a plurality of holders 19 for objects to be plated attached to a plurality of bars 18 crossing therewith. Said rack 9 also has two holes 20 for determining the descending positions.

Figure 14:
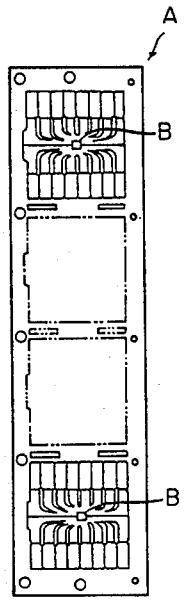
FIG. 14 is a plan view showing one example of a rectangular object for plating.
Figure 15:
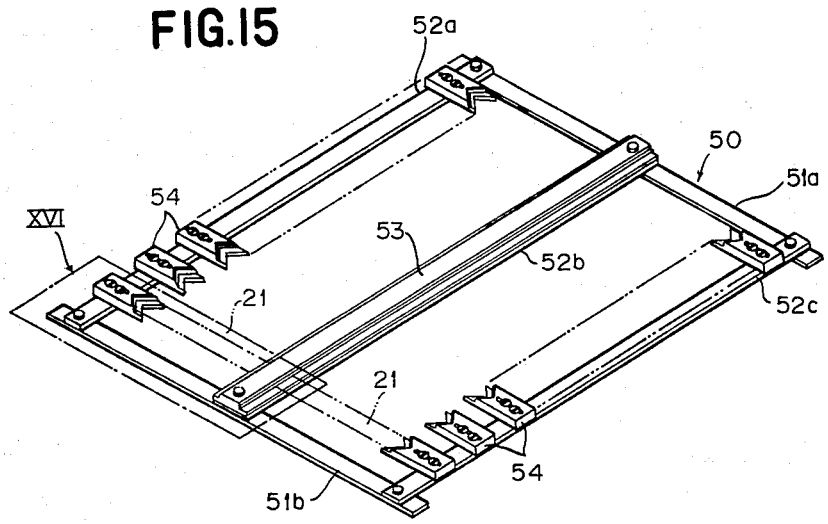
FIG. 15 is a schematic perspective view of a rack base for an alternate example of the carriage for objects to be plated.

The rectangular sheets 21 to be plated, of which one type is the IC lead frame A shown in FIG. 14, are aligned and supported on the rack base 17 as the two edges of each are received by the holders 19.

Above the respective dipping plating tanks 1, 2, 3, 4, and 5 are provided respectively holding members 22 for the sheets to be plated and the pressure means 23. A plurality of the holding members 22 are to be placed above the plurality of objects to be plated 21 which are aligned and supported on respective holders 19 such that said holding members 22 can be freely brought closer or moved away therefrom. The holding member 22 comprises respectively a frame base 24 and a plurality of hold ribs 25. The frame base 24 is attached to the lower end of a pair of suspension bars 27 which are in turn attached to a pressure frame 26 which comprises the pressure means 23. The hold ribs 25 are positioned on the frame base 24, with their positions being variable, and they extend downwardly from the frame base 24.

Figure 5:
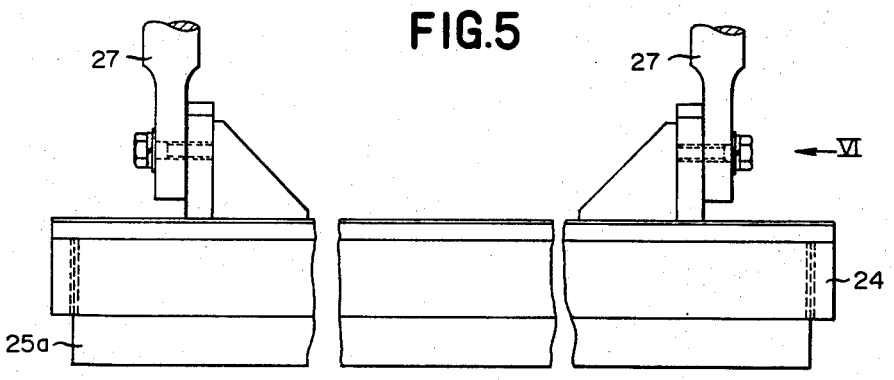
FIG. 5 is a front view of one embodiment of a holding means for holding the objects to be plated.
Figure 6:
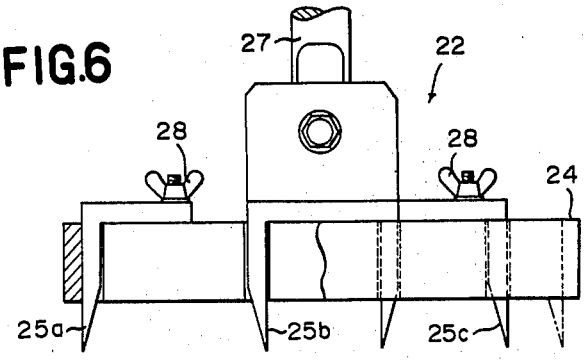
FIG. 6 is a side view seen in the direction of the arrow VI in FIG. 5.
Figure 7:
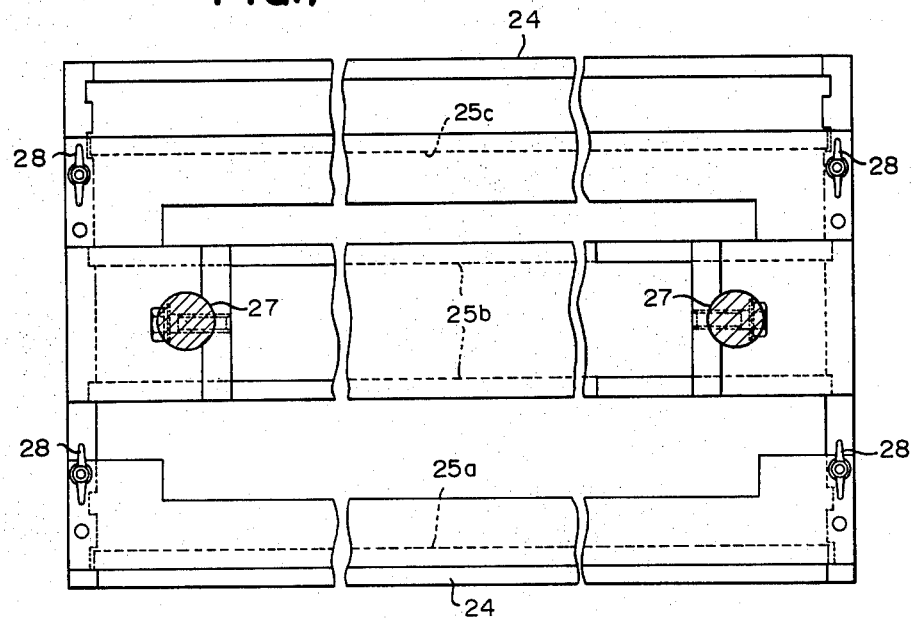
FIG. 7 is a plan view of the holding means shown in FIG. 5.

In the embodiment shown in FIG. 6, the center hold rib **25*b* acts as the main hold rib, while the ribs 25*a*, 25*c* act as supplemental hold ribs. The ribs 25*a*, 25*c* are fixed on the frame base 24 with their positions being variable by butterfly nuts 28 as shown in FIGS. 5 through 7. The weight of the hold ribs may be utilized instead of butterfly nuts. The hold rib 25*b* has a cross section shaped like an inverted channel, whereas the other hold ribs 25*a* and 25*c* have an inverted L-shape. As the lower edges of the hold ribs 25*a*, 25*b*, and 25*c* contact a plurality of objects 21 to be plated simultaneously, said hold ribs have a length corresponding to that of the cross bar of the rack base 17 as shown in FIG. 5**.

The hold ribs **25*a*, 25*b*, and 25*c* are made of synthetic resins (such as PVC) in the embodiment shown and therefore they are insulating; however, it is possible to use conductive metal for the ribs (as in the electrolytic degreasing tank 1**).

The pressure means 23 comprises a pressure cylinder 30 installed on the table 29, a pair of pressure frames 26 attached to the lower end of the piston rods of cylinder 30, a plurality of pressure bars 31 suspended from the pressure frame 26, and a pair of suspension bars 27 whose lower ends are attached to said holding member 22. Reference numeral 32 denotes a guide bar for guiding the pressure frame 26 as it moves vertically and said guide bar extends through the table 29.

A set of four pressure bars 31 contacts the rack 9 of the carriage 7 on the upper surfaces of the bush plates 15 at arbitrary positions (four positions).

The length of the respective pressure bars 31 and that of the pair of suspension bars 27 are predetermined to be such that the holding member 22 (or more specifically the holder ribs **25*a*, 25*b*, and 25*c*) will abut against the object to be plated 21 when the pressure bars 31 contact the bush plates 15**.

Figure 3:
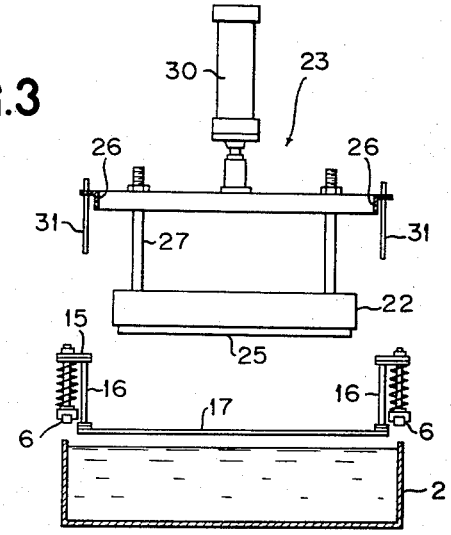
FIG. 3 is a schematic sectional view along the line III—III in FIG. 1.
Figure 4:
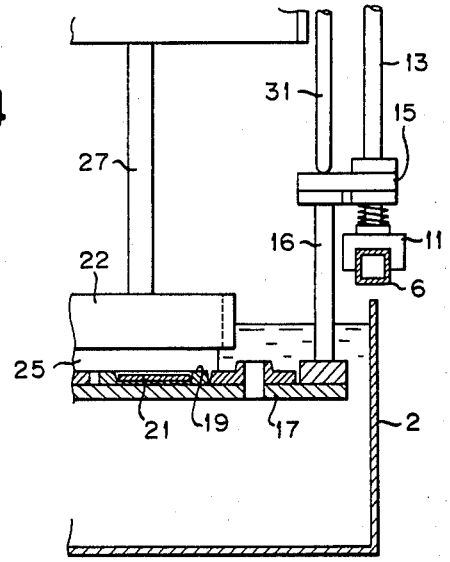
FIG. 4 is an enlarged view of a fragment of FIG. 3 to show the details of the apparatus in use.

The operation of the apparatus will now be explained with reference to FIGS. 3 and 4. As the pressure cylinder 30 works to push a pair of pressure frames 26 down via the piston rod thereof, a set of four pressure bars 31 presses down the rack base 17 as they abut against the bush plate 15. At the same time, the holding means 22 is lowered by a pair of pressure frames 26 and a pair of suspension bars 27 to cause the plurality of pressure ribs 25 to contact the upper surfaces of the objects to be plated 21. In this state, application of more pressure on the pressure bars 31 will further cause the rack base 17 to enter the tank 2 so that the objects 21 are dipped in the cleansing water. As the objects 21 are firmly held at their upper surfaces by the hold ribs **25*a*, 25*b* and 25*c*, they will not become free from the holders 19. In this case, the ribs may be positioned a short distance away from the upper surfaces of the objects 21, thus barely preventing the objects 21** from becoming free by means of the concave portions of the holders.

Another embodiment of the present invention will now be explained with reference to FIGS. 8 through 12.

The only difference between the two embodiments (FIGS. 1–7 and FIGS. 8–12) is the means of holding the objects to be plated, and therefore explanation of the identical portions will not be given. The holding member **22*a* (see FIG. 12) comprises a support bar 34 on which are formed a plurality of through-holes 33 and a suspension pin 35 which acts as a positioning means, a frame base 36 which is attached to the lower end of the suspension bars 27*a*, and movable weights 37 passed freely through the respective through-holes 33 of the support bar 34. The weight 37 is provided with a flange 38 at its upper end to prevent it from falling out, and there is a lead wire 39 connected to its top. It is also quite possible to make the weight 37 a non-conductor as in the case of the embodiment of FIGS. 1–7**.

The manner in which the present embodiment operates will now be explained with reference made to FIGS. 8 and 9. The pressure cylinder 30 works to lower a pair of pressure frames 26 which is the same as that explained in the aforementioned embodiment. (FIGS. 1–7) When a pair of suspension bars **27*a* is lowered, the frame base 36 (see FIG. 12) becomes lowered and causes the suspension pin 35 to engage within the hole 20 of the rack base 17, and the lower end of the weights 37 abut against the upper surface of the objects 21 respectively. As a set of four pressure bars 31 is pressing against the upper surface of the bush plates 15, the weights 37 while abutting against objects 21 becomes lowered and enters the strike plating tank 5 along with the rack base 17 and the objects 21 to be plated. Within the tank 5 is provided an anode 40 and the weight 37 is activated via the lead wire 39** to perform plating (for instance, the overall strike plating).

Figure 8:
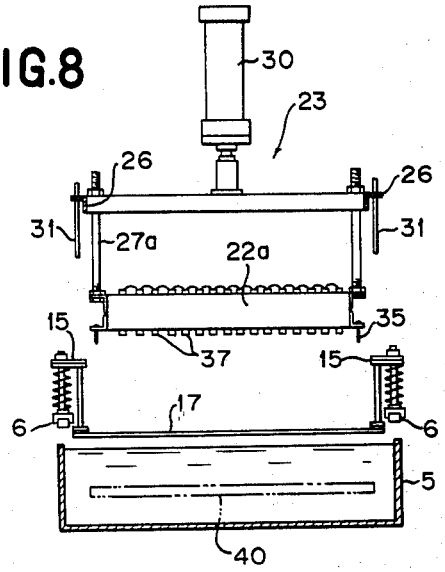
FIG. 8 is a schematic view along the line VIII—VIII in FIG. 1 but showing a different embodiment.
Figure 9:
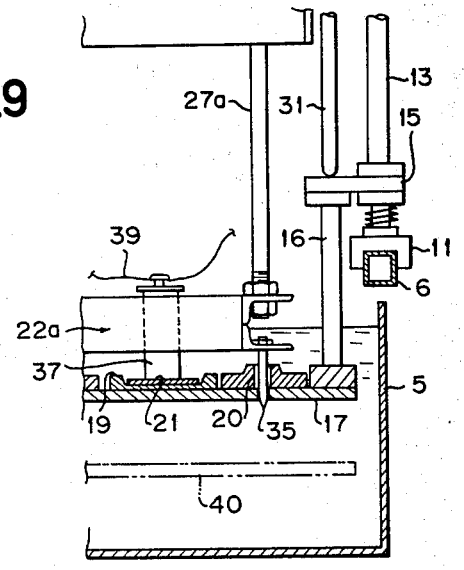
FIG. 9 is an enlarged view of a fragment of FIG. 8 showing the details of the apparatus in actual use.
Figure 10:
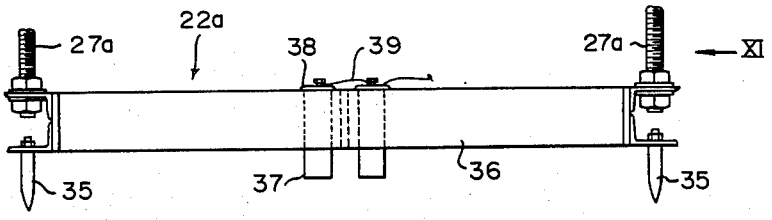
FIG. 10 is a front view of the holding means for the objects to be plated shown in FIG. 8.
Figure 11:
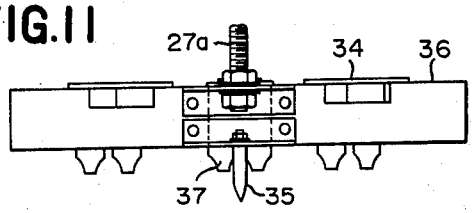
FIG. 11 is a side view seen from the direction of the arrow XI in FIG. 10.
Figure 12:
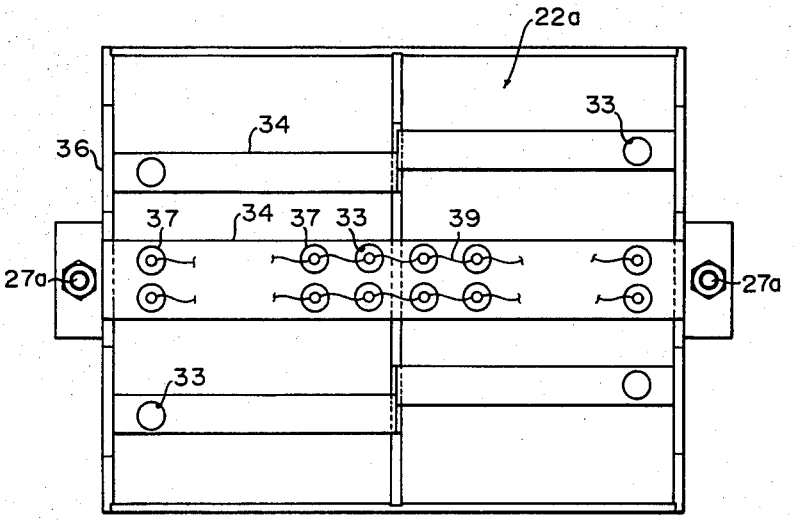
FIG. 12 is a plan view of the holding means of FIG. 10.

The holding member 22 or **22*a* may be arbitrarily selected from among those shown in FIGS. 3 to 7 and/or those shown in FIGS. 8 and 12, depending on the dipping plating process intended. It is also possible to combine the rib 25 and the weight 37 and use them as the holding means. The support carriage 7 and the pressure means 23** may be used commonly with these holding means when they are used singly or in combination.

As has been described heretofore, the present invention facilitates efficient lowering and positioning of the plurality of objects to be plated which are aligned and supported on the support carriage, and also facilitates holding these objects by means of a holding member. A plural number of holding ribs or weights of the holding means may be made either conductive or non-conductive, so that plating to be conducted in the dipping plating tanks (i.e. washing with water where no current needs to be passed, electrolytic degreasing where current needs to be passed, or the overall strike plating) may be conducted concurrently with positioning of the objects as they are lowered into tanks. Said holding member allows play in the upward direction of the weight when the weight is used, and abuts against the objects to be plated carefully so as not to damage such objects.

In the apparatus for dipping plating in accordance with the present invention, the support carriage 7 for supporting the objects to be plated plays an important role and therefore the detailed description of the support carriage 7 shown in FIG. 2 is given below.

When plating a rectangular object, such as IC lead from A obtained by press working and etching a thin metal piece shown in FIG. 14, it is necessary to plate the portion B with gold or other precious metal. It is much more efficient to process a plural number (for instance 10 to 20) of sheets in one batch rather than process each individually. Therefore, it is necessary to align a plural number of objects horizontally in advance, and as the plating operation is conducted over a line comprising various pre-treatments (such as washing with water, degreasing, activation, strike plating, etc.), the plating process proper, and the post-treatment (washing with water, washing with hot water, drying, etc.), it is also necessary to transfer the objects to be plated horizontally in line and to vary the height of the surface to be processed at various steps by moving the objects to be plated vertically.

Figure 13:
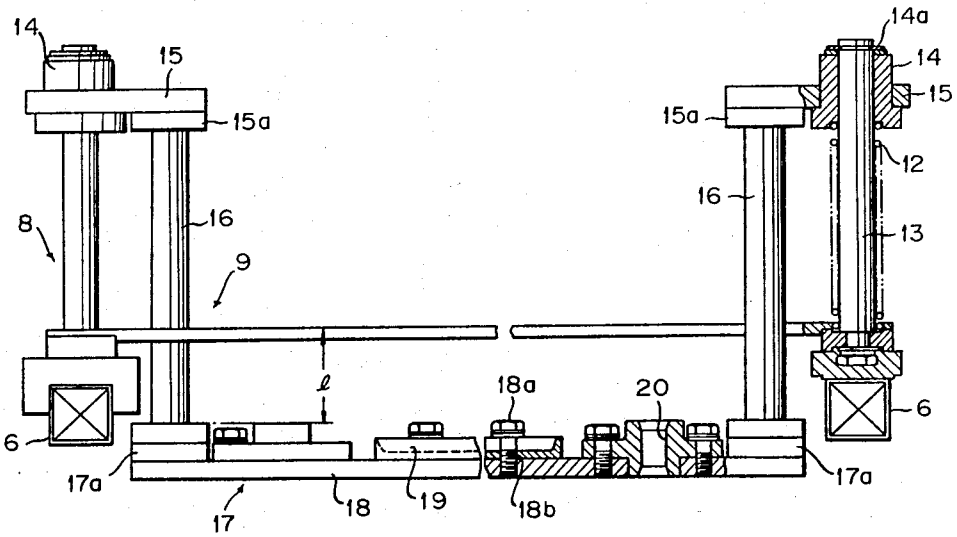
FIG. 13 is a side view of the carriage for supporting objects to be plated shown in FIG. 2 seen from the direction of the arrow XIII of FIG. 2.

In FIGS. 2 and 13, the support carriage 7 which complies with such requirements is shown. More specifically, the support carriage 7 comprises a carrier 8 and a rack 9 wherein the rack 9 is supported in a suspended position, and a plurality of holders 19 are fixed to the rack 9 in such a way that their positioning is freely adjustable. By installing the positioning means on the rack 9, the applicability of said positioning means is improved greatly and the carriage may be used throughout all of the steps of the plating line with a greater ease in use and manufacture, thereby improving the design freedom of the apparatus for the whole plating line. As mentioned above, the movable carrier 8 is placed on a pair of rails 6, and it has sliders 11 on the lower surface of the frame-shaped carrier base 10 which sliders respectively engage with the rails 6. The carrier 8 is further provided with standing bars 13 on the upper surface.

The reference numeral 12 denotes a spring provided outside the standing bar 13, the lower end of which abuts against the upper surface of the carrier base 10, and the upper end of which abuts against the mobile bush 14 attached to the upper portion of the standing bar 13. The mobile bush 14 is prevented from becoming loose from the standing bar 13 by the stopper ring 14*a*.

The rack 9 is suspended from the carrier 8 as above described and is lowered by pressure applied from another source. The rack 9 rises and returns automatically to the original position when pressure is relieved. Opposing sides 17*a* of the frame rack base 17 are connected to the mobile bushes 14 via the bush plates 15, 15*a* and the suspension bars 16. The rack base 17 is suspended within the frame shaped carrier base 10 and below said carrier base, so that the length of the suspension bar 16 is longer by l than the standing bar 13. The rack base 17 has cross bars (three in FIG. 2) 18 upon which the holders 19 for objects to be plated are fixed. The holders 19 comprise sectioned pieces instead of a long piece, and a plurality of these sections are to be fixed to each cross bar 18 respectively. The holders 19 are provided with concave portions of a size and shape adapted to receive the end portions of the objects 21. In the embodiment illustrated in FIG. 2, there is shown a holder 19 which is to be attached by placing said holder 19 on the center cross bar, upon which are formed concave portions on the opposing two sides. On the other hand, the holders attached to the two cross bars on both sides has a concave portion only on one of the opposing sides. These holders 19 are to be fixed upon the cross bars 18 by screws 18*a* passing through holes 18*b* which have a size somewhat bigger than that of the screw 18*a* in order to allow fine adjustment of the positions at which they are to be stopped. (See FIG. 13). This fine adjustment is suitably conducted depending on such conditions as the degree of parallelism, the degree of opposing distance, etc. There is provided a clearance between the holders 19 and 19 as shown in FIG. 2, and other holders also are attached with such a clearance therebetween.

The operation of the support carriage will now be explained. By using a vacuum device not shown in the drawing, the objects 21 to be plated, for instance twenty sheets of such objects, are concurrently set on the holders 19.

As shown in FIG. 1, on the plating line are placed five support carriers 7 over the pair of rails 6 contacting respectively the carrier bases 10, and as the support carriage at the extreme left is subjected to pressure from a suitable pressure means from the left direction in the drawing, the carrier bases 10 of the respective carriages are pushed and all five of the carriages move towards the right by one step. The plating line comprises five plating tanks 1, 2, 3, 4, and 5 and the respective support carriage 7 which moves one step [the length corresponding to that of the carrier base 10] and stops right over the next tank. As the pressure cylinder 30 of the pressure means 23 positioned above the tank is activated, the pressure bars 31 descends via bush plate 15 of the common support carriage 7, or more specifically the rack base 17. As the rack base 17 is connected to the mobile bush 14 via the suspension bar 16 and the bush plates 15 and 15*a*, the rack base 17 as a whole descends against the elasticity of the spring 12. The limit of its descent is arbitrarily determined by the distance which is the sum of the height of the standing bar 13 and the length of the suspension bar 16 extending downwardly from the standing bar 13. Into the respective tanks 1, 2, 3, 4 and 5, the rack base 17, the holder 19 and the twenty objects to be plated 21 descend, enter together and stop at a predetermined position, whereby they are subjected to plating in those tanks 1, 2, 3, 4 and 5. At this time, the holding members 22, 22*a* are pressed downwardly via a pair of suspension bars 27 to contact the upper surface of the objects 21. Even with the cleansing water or the processing liquid impinging forcefully upon the objects 21, the objects 21 are not allowed to float and become detached from the concave portion of the holders 19 since the holding members 22 or 22*a* are holding the objects adjacent thereto.

When the prescribed plating processes have been performed in the respective dipping plating tanks 1, 2, 3, 4 and 5, the pressure bar 31 returns, and the rack base 17 automatically ascends and returns to its original position as the mobile bush 14 ascends by means of the elasticity of the spring 12. A carrier base 10 is pressed by the carrier base of the other support carriage into position above the next tank, whereby the five support carriages 7 move on respectively.

Other modifications of the support carriage will now be explained with reference to FIGS. 15 to 20. In these figures, the rack base and its accessories are shown while the carrier, etc. are not shown.

The carriage, or more concretely its rack base, uses a fixed holder and a mobile holder to support the objects to be plated, and there is provided a continuous step portion in the longitudinal direction on the fixed holder. There is also provided a concave portion with a step on the mobile holder to allow the rack base to support objects with different widths and lengths.

The structure of the support carriage will now be explained. The reference numeral 50 denotes a rack base shaped like a frame comprising a pair of opposing sides 51*a*, 51*b* and three cross bars 52*a*, 52*b* and 52*c*. One of the cross bars 52*b* at the center in the embodiment shown is provided with a fixed holder 53, while the other cross bars 52*a* and 52*c* in the embodiment shown are provided with a plurality of mobile holders 54.

The fixed holder 53 may be constructed by joining a plural number of sections over the cross bar 52*b*, or in the alternative one long piece may be placed over the cross bar 52*b*. If one long piece is to be used for fixed holder 53, the cross bar 52*b* itself may be formed as an integral part of the fixed holder 53 instead of being formed as a separate cross bar 52*b*. On the fixed holder 53 is formed a support step 55 continuing in the longitudinal direction on the opposing side 56. 57 denotes a sloping guide for facilitating the setting of the objects 21 to be plated.

The plural number of mobile holders 54 are identically shaped and structured, and the following description is given for one mobile holder 54. The mobile holder 54 is movable in respect of its position in the longitudinal direction of the objects 21 over the cross bars 52*a*, 52*c*. For facilitating change of positions, the mobile holder 54 has a long orifice 58 through which are inserted two stopper screws 59 screwed to the lower ends of the cross bars 52*a*, 52*c*. When these screws 59 are removed, the mobile holder 54 may be freely replaced with the another type of mobile holder.

Figure 16:
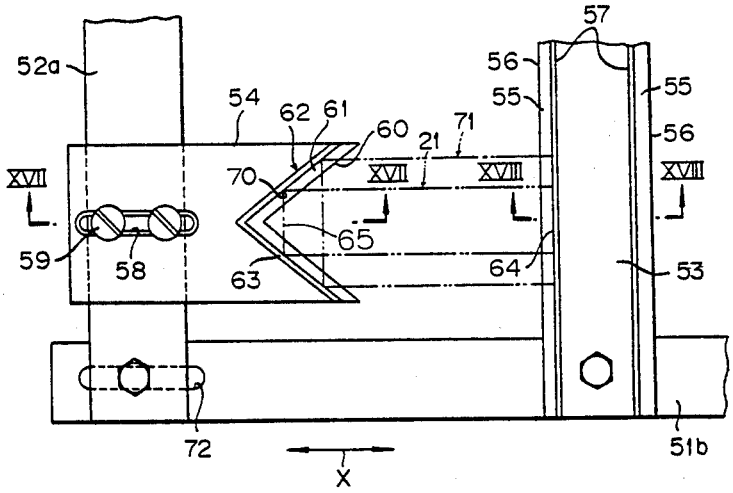
FIG. 16 is an enlarged plan view of the fragment XVI of FIG. 15.
Figure 17:
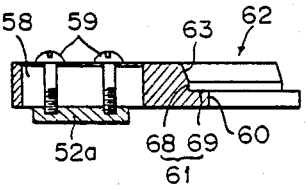
FIG. 17 is a cross sectional view along the line XVII—XVII in FIG. 16.
Figure 18:
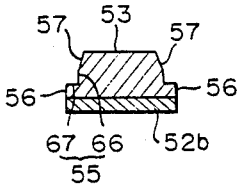
FIG. 18 is a cross sectional view along the line XVIII—XVIII in FIG. 16.

The mobile holder 54 further forms a concave portion 62 provided with a support step 61 on the opposing sides 60. It is possible to shape the concave portion 62 like a bowinstead of a triangle as shown in FIG. 16. The reference numeral 63 identifies a sloping guide for facilitating setting of the objects 21 to be plated.

The operation of the mobile holder will now be explained. In order to align and set a plurality of objects 21 on the rack base, one end 64 of the object 21 may be positioned on the support step 55 and the other end 65 on the support step 61. One end of the object 21 is received by the elevated portion 66 and the horizontal portion 67 of the support step 55 while the other end 65 is received by the elevated portion 68 and the horizontal portion 69 of the support step 61. Looking at this structure from above, the corner 70 of the other end 65 is snugly inserted into a triangular concave portion 62. This triangular concave portion 62 can receive objects 71 having different lengths and widths, and if the two stopper screws 59 are somewhat loosened and the mobile holder 54 is moved in the direction of the length of the objects 21 and 71 to be plated by utilizing the orifice 58, still more suitable support for various objects 21 and 71 can be obtained. If there is formed a second orifice 72 in the direction of X at the position where the opposing sides 51*a*, 51*b* cross the bars 52*a*, 52*b* and 52*c*, adjustment for both the above mentioned orifice 58 and the second orifice 72 becomes possible.

Figure 19:
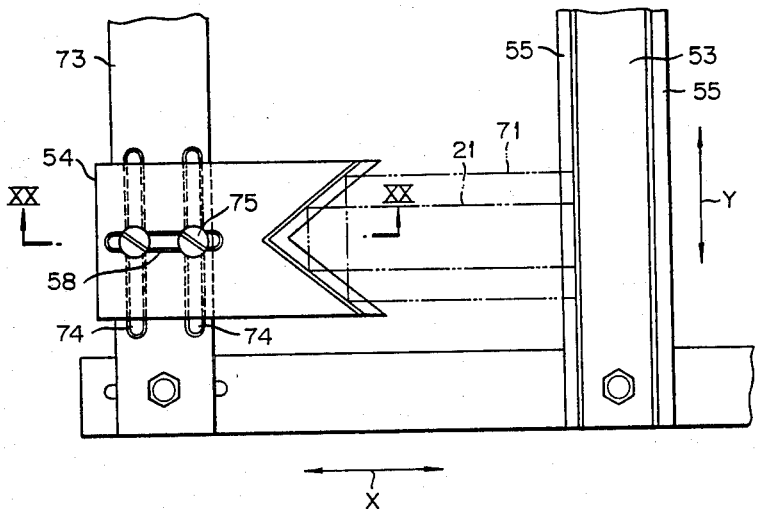
FIG. 19 is a partial plan view of another embodiment of the rack base.
Figure 20:
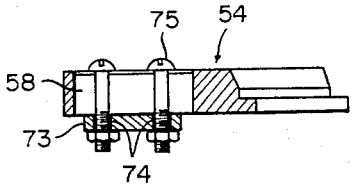
FIG. 20 is a cross sectional view along the line XX—XX in FIG. 19.

Another embodiment of the present invention is shown in FIGS. 19 and 20. This embodiment provides the mobile holder 54 with mobility in the direction of the width Y of the objects 21 and 71 to be treated. In other words, two slits 74 are formed on the cross bar 73, and stopper screws 75 passing through the orifice 58 of the holder 54 and the said slit 74 are used. According to this embodiment, the holder 54 may be moved in the direction of the width Y in addition to that of the length X of the objects 21 and 71 to be plated. When the holder 54 is moved in the direction Y, the one end of the objects 21 and 71 may be supported at an arbitrary position on the support step 55 continuously provided in the direction of the length of the fixed holder 54, thereby facilitating positioning of the objects 21 and 71 at desired positions in the horizontal direction.

What we claim is:

1. An apparatus for dipping plating, comprising:

a dipping plating tank;

a pair of spaced, elongated rails supported above said plating tank;

a support carriage including a carrier base supported on said rails for movement therealong and a rack base suspended from and supported on said carrier base for upward and downward movement with respect to said carrier base in directions toward and away from said plating tank, said rack base having first means for holding the objects to be plated;

pressure means disposed above said plating tank for effecting said movement of said rack base downwardly and upwardly toward and away from said plating tank, said pressure means including a fluid pressure operated piston and cylinder assembly having a downwardly extending piston rod, a pressure frame connected to the lower end of said piston rod, at least one downwardly extending pressure bar secured to said pressure frame and engageable with said rack base as said pressure frame is moved downwardly for pressing said rack base downwardly relative to said carrier base, and at least one suspension bar secured to and extending downwardly from said pressure frame; and second holding means secured to the lower end of said suspension bar so as to be adjacent said objects to be plated on said rack base when said pressure bar is engaging said rack base for resisting disengagement of said objects from said first holding means on said rack base.

2. The apparatus for dipping plating claimed in claim 1, wherein said second holding means for the objects to be plated comprises:

a frame base attached to the lower end of said suspension bar; and a plurality of pressure ribs adjustably supported on said frame base and extending downwardly therefrom, the lower ends of said pressure ribs being adjacent said objects to be plated when said pressure rod is engaging said rack base.

3. The apparatus for dipping plating claimed in claim 2, wherein said pressure ribs are made from an electrically conductive material and firmly engage said objects to be plated when said pressure rod is engaging said rack base.

4. The apparatus for dipping plating claimed in claim 2, wherein said pressure ribs are made from an electrically non-conductive material.

5. The apparatus for dipping plating claimed in claim 1, wherein said second holding means for said objects to be plated comprises:

a frame base having a substantially horizontal support bar with a plurality of spaced, vertical holes therethrough; and a plurality of weights, each said weight being slidably received in a respective said hole and having means thereon for retaining it in said hole, said objects to be plated engaging the lower ends of said weights and lifting said weights slightly within said holes when said pressure rod is engaging said rack base, whereby said weights resist disengagement of said objects from said first holding means on said rack base.

6. The apparatus for dipping plating claimed in claim 5, wherein each of said plural weights is made from an electrically conductive material.

7. The apparatus for dipping plating claimed in claim 5, wherein each of said plural weights is made from an electrically non-conductive material.

8. The apparatus for dipping plating claimed in claim 1, wherein said second holding means is in engagement with said objects to be plated when said pressure bar is engaging said rack base.

9. An apparatus for dipping plating comprising:

a plurality of dipping plating tanks, each said tank corresponding to a plating processing step;

a pair of spaced, elongated rails supported above said plating tanks;

a plurality of support carriages, each said support carriage having a carrier base supported on said pair of rails for movement therealong and a rack base suspended from and supported on said carrier base for upward and downward movement with respect to said carrier base in directions toward and away from a respective said plating tank, said rack base having first means for holding the objects to be plated;

pressure means disposed above said plating tanks for moving said rack bases downwardly and upwardly toward and away from said plating tanks, said pressure means including at least one fluid pressure operated piston and cylinder assembly having a downwardly extending piston rod, a pressure frame attached to the lower end of said piston rod, a plurality of downwardly extending pressure rods secured to said pressure frame and engageable with respective said rack bases as said pressure frame is moved downwardly for pressing said rack bases downwardly with respect to said carrier base, and a plurality of suspension bars secured to and extending downwardly from said pressure frame; and a plurality of second holding means secured to the lower ends of respective said suspension bars above respective said rack bases so as to be adjacent said objects to be plated on said rack bases when said pressure rod is engaging said rack base for resisting disengagement of said objects from said first holding means on said rack bases.

10. The apparatus for dipping plating claimed in claim 9, wherein each said second holding means for the objects to be plated comprises:

a frame base attached to the lower end of at least one said suspension bar; and a plurality of pressure ribs adjustably supported on said frame base and extending downwardly therefrom, the lower ends of said pressure ribs being adjacent said objects to be plated when said pressure rods on the associated second holding means are engaging the rack base.

11. The apparatus for dipping plating claimed in claim 10, wherein said pressure ribs are made from an electrically conductive material.

12. The apparatus for dipping plating claimed in claim 10, wherein said pressure ribs are made from an electrically non-conductive material.

13. The apparatus for dipping plating claimed in claim 9, wherein each said second holding means for objects to be plated comprises:

a frame base having a substantially horizontal support bar with a plurality of spaced, vertical holes therethrough; and a plurality of weights, each said weight being slidably received in a respective said hole and having means thereon for retaining it in said hole, said objects to be plated engaging the lower ends of said weights and lifting said weights slightly within said holes when said pressure rods are engaging the rack base, whereby said weights resist disengagement of said objects to be plated from said first holding means on the rack base.

14. The apparatus for dipping plating claimed in claim 13, wherein each of said plural weights is made from an electrically conductive material.

15. The apparatus for dipping plating claimed in claim 13, wherein each of said plural weights is made from an electrically non-conductive material.

16. The apparatus for dipping plating claimed in claim 9, wherein each said second holding means is engaged with the associated objects to be plated when said pressure rod is engaging said rack base.

17. The apparatus for dipping plating claimed in claim 1 or claim 9, wherein:

said carrier base has sliders on opposite sides thereof for slidably engaging said rails, at least one standing bar extending upwardly from said carrier base and having a coil spring therearound and a bush slidably supported on its upper end, said coil spring urging said bush upwardly; and said rack base includes at least one suspension bar connected to said bush so that said coil spring urges said rack base upwardly, includes a plurality of cross bars, said first holding means comprising a plurality of holders adjustably mounted on said cross bars includes means cooperable with said second holding means for aligning said second holding means with said rack base as said second holding means is lowered.

18. The apparatus for dipping plating as claimed in claim 17, wherein:

said rack base includes a frame comprising opposing sides which connect said plurality of cross bars;

one of said cross bars has a fixed holder formed with a support step which extends continuously in the lengthwise direction; and another of said cross bars a second holder mounted thereon for adjustment toward and away from said fixed holder, said second holder having a concave portion opposed to said fixed holder, said concave portion having a support step portion whereby the positions of the objects to be plated can be adjusted.

19. The apparatus for dipping plating as claimed in claim 1 or claim 9, wherein said second holding means includes means cooperable with said associated rack base for positioning said second holding means with respect to said rack base as said pressure means lowers said second holding means relative to said rack base to said position adjacent said rack base.

* * * * *

UNITED STATES PATENT AND TRADEMARK OFFICE

CERTIFICATE OF CORRECTION

PATENT NO. : 4,351,266

DATED : September 28, 1982

INVENTOR(S) : Masato Ando et al.

It is certified that error appears in the above-identified patent and that said Letters Patent is hereby corrected as shown below:

Column 8, line 41, "bar" should read -- rod --.

Column 9, line 56, "base" should read -- bases --.

Column 10, line 54, after "bars" insert -- and --.

Column 10, line 65, after "bars" insert -- has --.

Signed and Sealed this

First Day of February 1983

[SEAL]

Attest:

GERALD J. MOSSINGHOFF

Attesting Officer

Commissioner of Patents and Trademarks